United States Patent [19]

Cho

[11] Patent Number: 4,493,431

[45] Date of Patent: Jan. 15, 1985

[54] CAN OPENING MEANS

[76] Inventor: Sung N. Cho, San 16-75, Dae Chi-Dong, Kang Nam-Ku, Seoul, Rep. of Korea

[21] Appl. No.: 369,252

[22] Filed: Apr. 16, 1982

[30] Foreign Application Priority Data

Apr. 24, 1981 [KR] Rep. of Korea ..... 2934

[51] Int. Cl.[3] ..... B65D 17/34

[52] U.S. Cl. ..... 220/269; 220/257; 220/258; 220/270

[58] Field of Search ..... 220/257, 258, 269, 270, 220/359, 260; 229/7 R

[56] References Cited

U.S. PATENT DOCUMENTS

| | | | |
|---|---|---|---|
| 3,251,515 | 5/1966 | Henchert et al. | 220/270 |
| 4,325,490 | 4/1982 | Conrad | 220/269 |
| 4,378,074 | 3/1983 | Brochman | 220/260 |

*Primary Examiner*—George T. Hall

*Attorney, Agent, or Firm*—Berman, Aisenberg & Platt

[57] ABSTRACT

A container having an opening which comprises a segment connected to the top of the container along an entire straight edge, and connected to the top of the container at other discrete points. The segment is covered by a piece of adhesive tape to seal the container. The tape has a tab for opening the container by bending the segment about the straight line connection. The container may be easily resealed by replacing the segment in the hole and by securing the tape against the top of the container.

6 Claims, 3 Drawing Figures

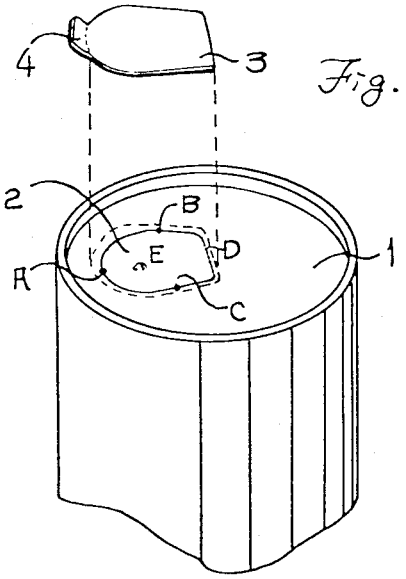
Fig. 1
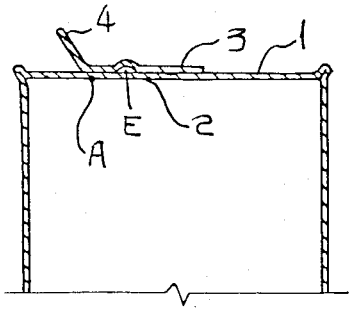
Fig. 2
Fig. 3
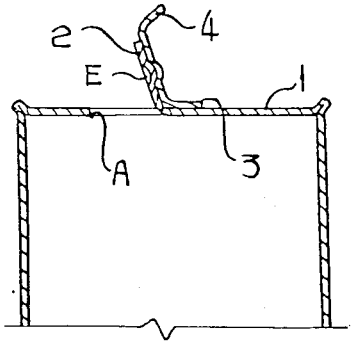

CAN OPENING MEANS

TECHNICAL FIELD

This invention relates to the art of containers having a top which includes an opening for pouring out the contents

BACKGROUND ART

Containers which are easily opened are known in the art. One known container is a cylindrical and has a generally planar top. The top includes a segment which is fixed to the remainder of the top by a thin portion of the top material and a tab is attached to the segment. The can is opened when the segment is removed by exerting a force on the tab. A second known type of container includes a top having a hole therein, where the hole is covered by a piece of tape which sticks to the perimeter of the hole on the top of the container. The container is opened by removing the tape from the top of the container to expose the hole.

These prior art containers suffer from several disadvantages. Production of the first mentioned type of container, wherein part of the top is connected to the remainder of the top by a weak connection, requires a difficult and complex process, and is consequently expensive. The second mentioned type of opening requires the adhesive tape to be specially treated since it comes into contact with the contents of the can. Furthermore, the use of tape alone to cover a hole is not adequate for sealing a container of a carbonated liquid, since the tape is inadequate for a pressurized container. In both of these types of containers it is extremely difficult to store the contents of the container after opening, because the part which is removed to open the container becomes detached and is discarded.

SUMMARY OF THE INVENTION

The invention provides a solution to the problems facing the prior art containers. The container of the invention includes a top having a segment with at least one straight edge which is joined to the remainder of the top and where the other edges of the segment are connected to the top at selected spots. The entire segment is covered with a piece of tape which adheres to the segment and to the top surrounding the segment.

It is an object of the present invention to provide a container having an easily opened top, which may be resealed.

It is another object of the present invention to provide a top for a container wherein a segment of the top may be easily removed to expose a hole in the top.

BRIEF DESCRIPTION OF THE DRAWINGS

FIG. 1 shows a perspective view of a container employing the invention.

FIG. 2 is a cross section of the container of FIG. 1 taken along line a vertical plane.

FIG. 3 is a cross section of the container of FIG. 1 showing the opening for emptying the contents of the container.

DETAILED DESCRIPTION OF THE INVENTION

FIG. 1 shows a cylindrical container 1. The top of the cylindrical container includes a segment 2 which is generally shaped like the letter "C". The segment 1 is connected to the top of the can along a straight edge D. The connection between the segment 2 and the can 1 along line D is a weak connection in that the segment 2 may be easily rotated about the line D. The remainder of the perimeter of the segment 2 is fixed to the top of the container 1 at several discrete locations, indicated at A, B and C. These connections may be made, for example, by spot welding. An adhesive tape 3, has a shape similar to the shape of the segment 2, but slightly larger. The adhesive tape 3 covers the segment 2 and extends onto the top of the container as shown by the dashed lines in FIG. 1. The piece of tape thus seals the portion of the perimeter of the segment 2 which is only secured at the discrete spots. The adhesive tape 3 also includes a tab 4 by which the tape may be grasped.

FIG. 2 shows the container 1, the segment 2, and the adhesive tape 3 in place covering the segment 2. A projection E extends outwardly from the segment 2 to provide a tighter attachment between the segment 2 and the piece of tape 3.

FIG. 3 shows the can in an opened condition. The tab 4 is grasped and the attachments at A, B and C are broken so that the segment 2 may be bent about the line connection D. The contents of the can may then be dispensed. The tape 3 and segment 2 are not removed from the container, and the container maybe easily closed by merely bending the segment 2 down to cover the hole and by reaealing the container with the tape 3.

The tape 3 may be a known aluminum adhesive tape.

An improved container has been disclosed which has many advantages over the prior art containers. The container of the invention can be used to store many kinds of liquids or solids because the opening of the container is covered by the same material as the remainder of the container, and thus does not require any treatment of the adhesive tape. Furthermore, since the opening is covered by rigid material, pressurized contents may be stored. The container may be easily opened, and since the segment is not removed from the container it may be easily resealed. Further advantages will be apparent to those of skill in the art.

What is claimed is:

1. A container comprising:

a top having a hole therein, a segment for filling said hole, having one edge secured to said top, said segment also being non-frangibly secured to said top at a discrete point spaced from said edge, and means for covering said segment and a portion of said top, for sealing said container.

2. The container of claim 1 wherein said means for covering said segment includes a tab.

3. The container of claim 2 wherein said means for covering is a piece of aluminum-containing adhesive tape.

4. The container of claim 1 wherein said segment has a projection for engaging said means for covering.

5. The container of claim 1 wherein said discrete point is a spot weld.

6. The container of claim 5 wherein said segment is secured to a plurality of evenly distributed discrete points.

* * * * *